US011221576B2

(12) United States Patent
Yoshida et al.

(10) Patent No.: US 11,221,576 B2
(45) Date of Patent: Jan. 11, 2022

(54) IMAGING DEVICE

(71) Applicant: HEWLETT-PACKARD DEVELOPMENT COMPANY, L.P., Spring, TX (US)

(72) Inventors: Yoichi Yoshida, Yokohama (JP); Yasuyuki Ishii, Yokohama (JP); Koichiro Takashima, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/050,732

(22) PCT Filed: Jun. 12, 2019

(86) PCT No.: PCT/US2019/036738
§ 371 (c)(1),
(2) Date: Oct. 26, 2020

(87) PCT Pub. No.: WO2020/013944
PCT Pub. Date: Jan. 16, 2020

(65) Prior Publication Data

US 2021/0116836 A1 Apr. 22, 2021

(30) Foreign Application Priority Data

Jul. 11, 2018 (JP) ..... JP2018-131701

(51) Int. Cl.
*G03G 15/00* (2006.01)
*G03G 15/02* (2006.01)
*G03G 15/08* (2006.01)

(52) U.S. Cl.
CPC ..... *G03G 15/5037* (2013.01); *G03G 15/0216* (2013.01); *G03G 15/0806* (2013.01);
(Continued)

(58) Field of Classification Search
CPC . G03G 21/0094; G03G 21/00; G03G 21/0035
See application file for complete search history.

(56) References Cited

U.S. PATENT DOCUMENTS 5,839,018 A 11/1998 Asanuma
5,974,280 A 10/1999 Takesue
(Continued)

FOREIGN PATENT DOCUMENTS

JP 19960305233 11/1996
JP 20050338636 12/2005
(Continued)

*Primary Examiner* — Walter L Lindsay, Jr.
*Assistant Examiner* — Jessica L Eley
(74) *Attorney, Agent, or Firm* — Staas & Halsey LLP

(57) ABSTRACT

An image forming apparatus includes an image carrier, a toner supply unit, an application roller adjacent to the image carrier, a toner measuring unit, and a control unit. The toner supply unit supplies toner to the image carrier. The application roller applies a lubricant to the image carrier. The toner measuring unit measures an amount of toner transferred from the image carrier to the application roller. The control unit adjusts the supply of toner to be supplied to the image carrier in accordance with the amount of toner measured by the toner measuring unit.

15 Claims, 6 Drawing Sheets

(52) U.S. Cl.
CPC ..... *G03G 15/0862* (2013.01); *G03G 15/556* (2013.01); *G03G 15/0813* (2013.01); *G03G 2215/00679* (2013.01); *G03G 2215/207* (2013.01); *G03G 2221/0084* (2013.01)

(56) References Cited

U.S. PATENT DOCUMENTS

| | | | | |
|---|---|---|---|---|
| 2009/0003858 | A1* | 1/2009 | Nishida | G03G 15/5037 399/48 |
| 2009/0324267 | A1 | 12/2009 | Yoshida | |
| 2010/0226666 | A1* | 9/2010 | Nakatsuhara | G03G 21/0035 399/43 |
| 2015/0030364 | A1* | 1/2015 | Ito | G03G 21/0094 399/346 |
| 2017/0261882 | A1* | 9/2017 | Saito | G03G 21/00 |

FOREIGN PATENT DOCUMENTS

| | | |
|---|---|---|
| JP | 20060201464 | 8/2006 |
| JP | 20110059315 | 3/2011 |
| JP | 20110169926 | 9/2011 |
| JP | 5263591 B2 | 8/2013 |

* cited by examiner

IMAGING DEVICE

CROSS REFERENCE TO RELATED APPLICATIONS

This application is filed under 35 U.S.C. 0.371 as a National Stage of PCT International Application No. PCT/US2019/036738, filed on Jun. 12, 2019, in the U.S. Patent and Trademark Office, which claims the priority benefit of Japanese Patent Application No. 2018-131701, filed on Jul. 11, 2018, in the Japan Patent Office. The disclosures of PCT International Application No. PCT/US2019/036738 and Japanese Patent Application No. 2018-131701 are incorporated by reference herein in their entireties.

BACKGROUND

An image forming apparatus may include a photoreceptor, a charging device, an exposure device for forming an electrostatic latent image on the photoreceptor, a developing device for applying toner to the electrostatic latent image and developing the image, a transfer device for transferring the toner image on the photoreceptor onto a transfer material, and a cleaning device for cleaning the transfer residual toner remaining on the photoreceptor without being transferred. The cleaning device may include a cleaning blade, a cleaning brush, a waste toner conveying member, and a lubricant supplied to the photoreceptor.

DESCRIPTION OF EMBODIMENTS

In the following description, with reference to the drawings, the same reference numbers are assigned to the same components or to similar components having the same function, and overlapping description is omitted. In some cases, drawings may be drawn in a simplified or schematic manner for the sake of clarity of example.

Figure 1:
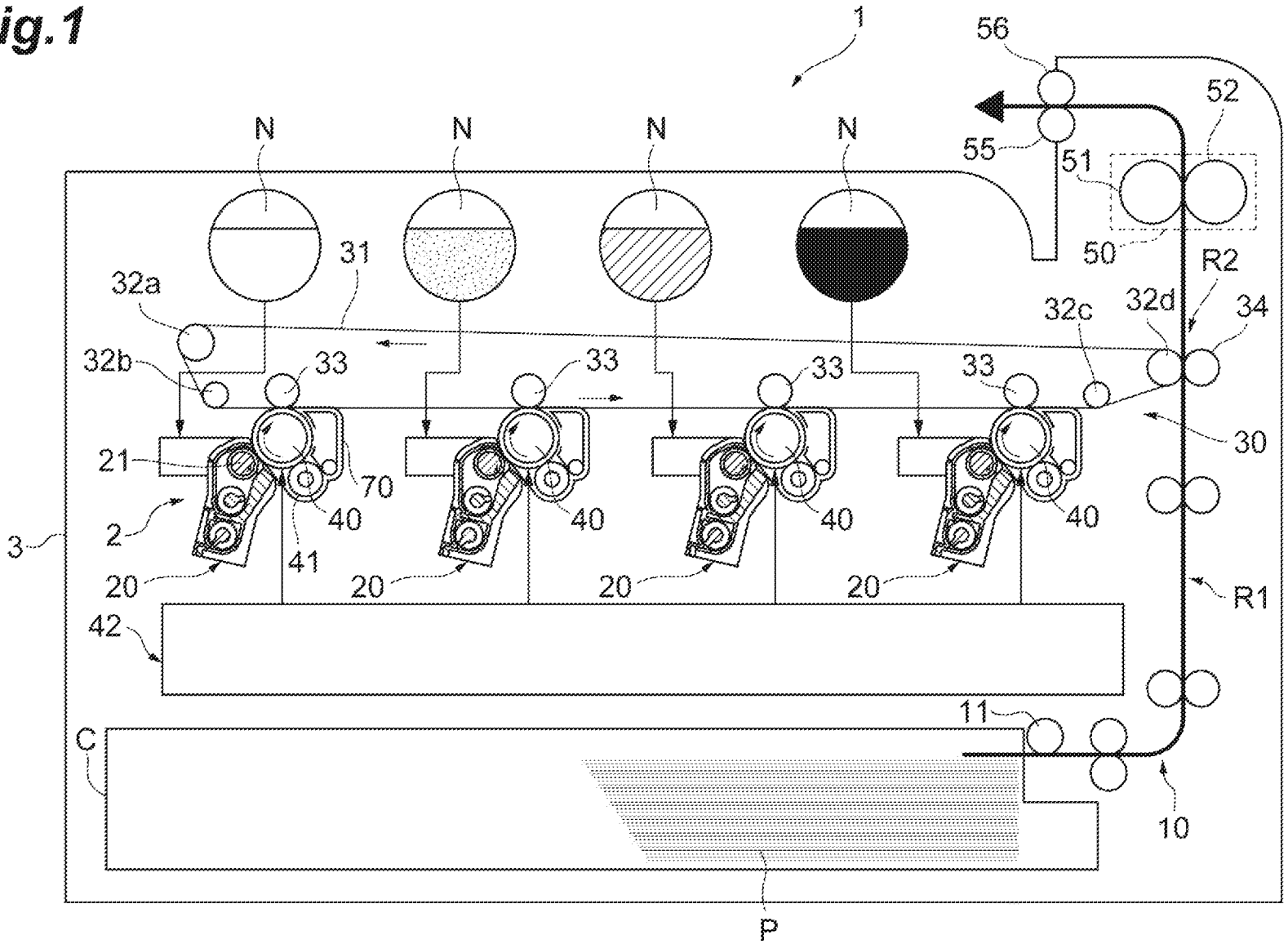
FIG. 1 is a schematic diagram of an example image forming apparatus.

With reference to FIG. 1, an image forming apparatus 1 as an example forms a color image, using magenta, yellow, cyan, and black colors. The image forming apparatus 1 may include, for example, a recording medium conveying device 10, a plurality of developing devices 20, a transfer device 30, an image carrier 40 that is a plurality of photoreceptors, and a fixing device 50. The recording medium conveying device 10 conveys the paper P as a recording medium. The developing device 20 develops an electrostatic latent image. The transfer device 30 secondarily transfers the toner image to the paper P. The image carrier 40 is an image carrier on which an image is formed on its outer circumferential surface. The fixing device 50 fixes a toner image on the paper P.

As an example, the recording medium conveying device 10 may include a paper feeding roller 11 that conveys the paper P on which an image is formed along a conveying path R1. The paper P is stacked and stored in a cassette C, and conveyed by being picked up by the paper feeding roller 11. The paper feeding roller 11 is provided near an exit of the paper P of the cassette C. The recording medium conveying device 10 causes the paper P to reach a secondary transfer region R2 via the conveying path R1 at a timing when the toner image transferred to the paper P reaches the secondary transfer region R2.

A developing device 20 may be provided for each color. Each of the developing devices 20 may include a developing roller 21 that causes toner to be carried on the image carrier 40. In the developing device 20, for example, the toner and carrier may be adjusted to have a predetermined mixing ratio, and the toner and carrier may be mixed and stirred to uniformly disperse the toner. The developer is carried on the developing roller 21. The developing roller 21 rotates to convey the developer to a region facing the image carrier 40. The toner of the developer carried on the developing roller 21 moves (transfers) to the electrostatic latent image of the image carrier 40, and the electrostatic latent image is developed.

For example, the transfer device 30 may convey the toner image formed by the developing device 20 and the image carrier 40 to the secondary transfer region R2. The image developed on the image carrier 40 is transferred, for example, to the transfer device 30. As an example, the transfer device 30 may include a transfer member 31, suspension rollers 32*a*, 32*b*, 32*c*, and 32*d*, a primary transfer roller 33, and a secondary transfer roller 34. The transfer member 31 may include, for example, a transfer belt suspended by the suspension rollers 32*a*, 32*b*, 32*c*, and 32*d*. A primary transfer roller 33 may be provided for each color. Each primary transfer roller 33 clamps the transfer member 31 together with each image carrier 40. The secondary transfer roller 34 clamps the transfer member 31 together with the suspension roller 32*d*.

The transfer member 31 may include, for example, an endless belt that circulates and moves by the suspension rollers 32*a*, 32*b*, 32*c*, and 32*d*. The primary transfer roller 33 presses the image carrier 40 from the inner circumferential side of the transfer member 31. The secondary transfer roller 34 presses the suspension roller 32*d* from the outer circumferential side of the transfer member 31. The image carrier 40 may include, for example, a photosensitive drum, and may be provided for each color. The plurality of image carriers 40 is arranged side by side along a moving direction of the transfer member 31. A developing device 20, an exposure unit 42, a charging device 41, and a cleaning device 70 are provided at facing positions of the outer circumferential surface of each image carrier 40.

The example image forming apparatus 1 may include a process cartridge 2 integrally including the developing device 20, the image carrier 40, the charging device 41 and the cleaning device 70, and an apparatus main body 3 to which the process cartridge 2 is attached and detached. The process cartridge 2 may be freely attachable to and detachable from the apparatus main body 3 by opening a door of the apparatus main body 3 and inserting the process cartridge 2 into and extracting the process cartridge 2 from the apparatus main body 3.

The charging device 41 may be arranged to uniformly charge the outer circumferential surface of the image carrier 40 to a predetermined potential. The charging device 41 may include, for example, a charging roller that rotates to follow the rotation of the image carrier 40. The exposure unit 42 exposes the outer circumferential surface of the image carrier 40 charged by the charging device 41 in accordance with the image to be formed on the paper P. The potential of a portion of the outer circumferential surface of the image carrier 40 exposed to the exposure unit 42 changes, and the electrostatic latent image is developed on the outer circumferential surface of the image carrier 40 accordingly.

Toner is supplied to each of the plurality of developing devices 20 from, for example, each of a plurality of toner tanks N disposed to face each of the developing devices 20. Each of the developing devices 20 develops the electrostatic latent image of each image carrier 40 with the supplied toner. As a result, the toner image is developed. The developing device 20 and the toner tank N may include toner supply units that supply toner to the image carrier 40. For example, magenta, yellow, cyan, and black toners are contained in each toner tank N. The cleaning device 70 removes the toner remaining on the outer circumferential surface of the image carrier 40 after the toner image formed on the outer circumferential surface of the image carrier 40 is primarily transferred to the transfer member 31. The cleaning device 70 is further described further below.

As an example, the fixing device 50 fixes the toner image, which was secondarily transferred to the paper P from the transfer member 31, onto the paper P. The fixing device 50 includes, for example, a heating roller 51 that heats the paper P and fixes the toner image onto the paper P, and a pressure roller 52 that pressurizes the heating roller 51. For example, the heating roller 51 and the pressure roller 52 are formed, for example, in a cylindrical shape. As an example, a heat source such as a halogen lamp is provided inside the heating roller 51. A fixing nip portion, which is a contact region, is located between the heating roller 51 and the pressure roller 52. As the paper P passes through the fixing nip portion, the toner image is melted and fixed onto the paper P. The image forming apparatus 1 may be further provided with discharge rollers 55 and 56 which discharge the paper P, on which the toner image has been fixed by the fixing device 50, to the outside of the image forming apparatus 1.

An example image forming method performed by the example image forming apparatus 1 will be described. The image forming method includes an example printing process. For example, when an image signal of an image to be recorded is input to the image forming apparatus 1, the paper P stacked on the cassette C may be picked up by the rotation of the paper feeding roller 11, and the paper P is conveyed along the conveying path R1. The charging device 41 uniformly charges the outer circumferential surface of the image carrier 40 to a predetermined potential on the basis of the image signal, and the exposure unit 42 irradiates the laser beam onto the outer circumferential surface of the image carrier 40 to form an electrostatic latent image on the outer circumferential surface of the image carrier 40.

Further, the developing device 20 forms a toner image on the image carrier 40 and performs development. For example, the toner image may be primarily transferred from each image carrier 40 to the transfer member 31 in a region in which the image carrier 40 and the transfer member 31 face each other. For example, toner images formed on each of the plurality of image carriers 40 are sequentially superimposed on the transfer member 31 to form a composite toner image. The composite toner image is secondarily transferred to the paper P conveyed from the recording medium conveying device 10 in the secondary transfer region R2 in which the suspension roller 32*d* and the secondary transfer roller 34 face each other.

The paper P to which the composite toner image is secondarily transferred is conveyed from the secondary transfer region R2 to the fixing device 50. The fixing device 50 may melt and fix the composite toner image on the paper P by, for example, causing the paper P to pass through the fixing nip portion, while applying heat and pressure to the paper P. The paper P may be discharged to the outside of the image forming apparatus 1, for example, by the discharge rollers 55 and 56.

Figure 2:
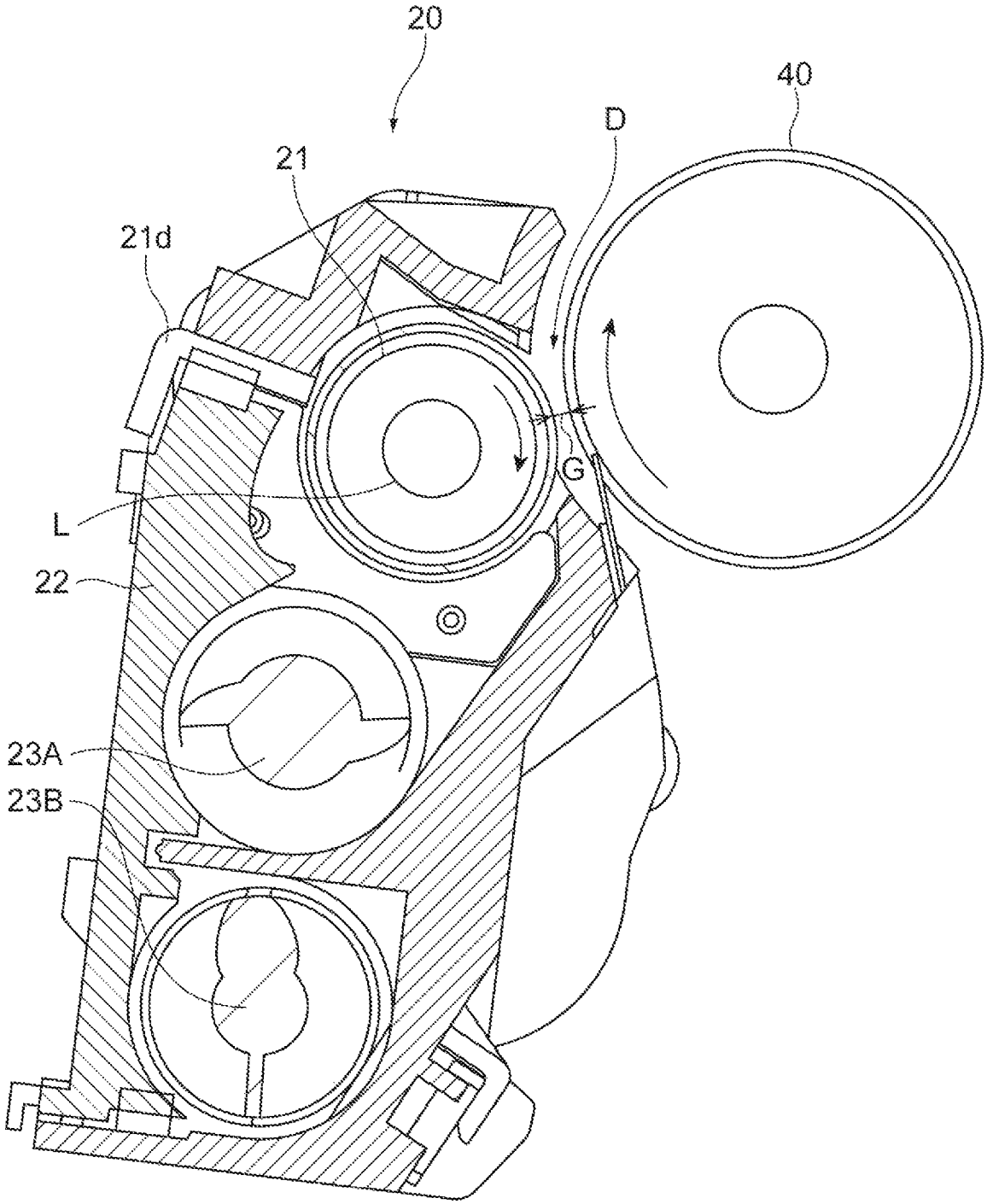
FIG. 2 is a cross-sectional view illustrating an example image carrier and an example developing device of the example image forming apparatus of FIG. 1.

With reference to FIG. 2, the developing device 20 may include, for example, the above-described developing roller 21, a developer accommodating portion 22 in which a two-component developer containing toner and carrier is contained, and a pair of stirring and conveying members 23A and 23B for conveying the developer accommodated in the developer accommodating portion 22, while stirring the developer. The developing roller 21 supplies toner to the image carrier 40, to form the electrostatic latent image on the outer circumferential surface of the image carrier 40. The developing roller 21 carries the developer stirred by the stirring and conveying members 23A and 23B. The surface of the developing roller 21 may be subjected to sand blasting, bead blasting, etching, or the like. A ten point average roughness Rz of the surface of the developing roller 21 may be, for example, of 24 μm to 90 μm, (e.g. within a range of 24 μm or more and 90 μm or less).

A developing region D is located between the developing roller 21 and the image carrier 40. The developing region D is a region for supplying toner of the developer carried on the developing roller 21 to the image carrier 40, and indicates a region in which the developing roller 21 and the image carrier 40 are close to each other. The developing roller 21 rotates in the developing region D such that the moving direction of the developing roller 21 is opposite to the moving direction of the image carrier 40. In the developing region D, assuming that an interval between the developing roller 21 and the image carrier 40 is an interval G, the value of the interval G may be, for example, of 150 μm to 350 μm (e.g. within a range of 150 μm or more and 350 μm or less). Further, the conveying amount of developer provided by the developing roller 21 may be, for example, of 150 g/m$^2$ to 300 g/m$^2$ (e.g. within a range of 150 g/m$^2$ or more and 300 g/m$^2$ or less).

Figure 3:
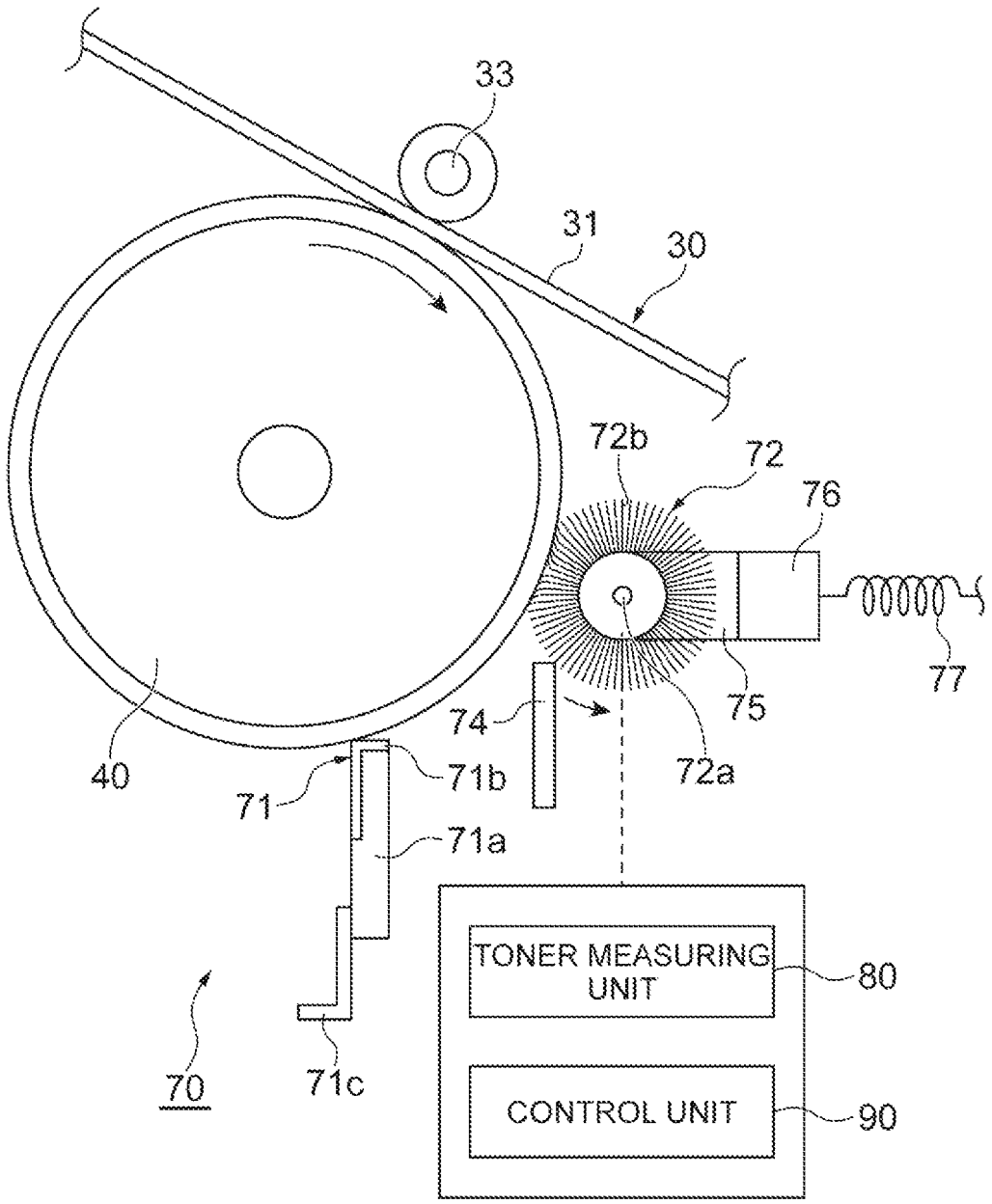
FIG. 3 is a side view illustrating components of an example image forming apparatus.

With reference to FIG. 3, an example of the cleaning device 70 of FIG. 1 is further described, which cleaning device 70 as an example may include a cleaning blade 71 to contact the outer circumferential surface of the image carrier 40, and an application roller 72 to contact the outer circumferential surface of the image carrier 40, located on an upstream side of the cleaning blade 71 in a rotational direction of the image carrier 40. The cleaning blade 71 may include, for example, a base material 71*a*, an edge portion 71*b* that covers the surface of the base material 71*a*, and a support 71*c* that supports the base material 71*a*. The edge portion 71*b* may include a polymer compound layer. The edge portion 71*b* is provided at a first end of the base material 71*a*, and the second end of the base material 71*a* is fixed to the support 71*c*.

The base material 71*a* may have a strip shape. As an example, the length of the base material 71*a* may be of 220 mm to 360 mm (e.g. within a range of 220 mm or more and 360 mm or less), and the width of the base material 71*a* may be of 5 mm to 15 mm (e.g. within a range of 5 mm or more and 15 mm or less). For example, the thickness of the base material 71*a* may be of 1.6 mm to 2.4 mm (e.g. within a range of 1.6 mm or more and 2.4 mm or less). The material of the base material 71*a* may be, for example, an elastic body such as rubber or a thermoplastic elastomer.

The edge portion 71*b* may be made of a flexible material. For example, the edge portion 71*b* may be made of a material in which a 100% modulus value at 23° C. may be of 6 MPa to 12 MPa (e.g. within a range of 6 MPa or more and 12 MPa or less). For example, the thickness of the edge portion 71*b* may be of 50 nm to 1000 nm (e.g. within a range of 50 nm or more and 1000 nm or less), and the modulus of elasticity of the edge portion 71*b* may be of 100 MPa to 1000 MPa (e.g. within a range of 100 MPa or more and 1000 MPa or less). The material of the support 71*c* may include, for example, a metal such as iron, copper, stainless steel, aluminum, aluminum alloy or nickel.

The application roller 72 may be provided at a position adjacent to the image carrier 40. The application roller 72 removes and holds at least a part of the toner remaining on the outer circumferential surface of the image carrier 40 from the image carrier 40. The application roller 72 may include a brush roller. The application roller 72 may include, for example, a metallic shaft portion 72*a* and a brush 72*b* fixed to the shaft portion 72*a*. The application roller 72 may be conductive.

The shaft portion 72*a* may extend in a direction in which the rotation axis of the image carrier 40 extends. As an example, the shaft portion 72*a* includes a base fabric in which the brush 72*b* is implanted as a plurality of bristles. In this case, when the brush 72*b* is implanted on the outer circumferential surface of the shaft portion 72*a*, each brush 72*b* is fixed to the shaft portion 72*a*. The material of the brush 72*b* is, for example, an acrylic fiber, a nylon fiber or a PET fiber.

As an example, the thickness of the brush 72*b* is 3 denier or more and 6 denier or less. For example, the density of the brush 72*b* may be of 50K lines/inch to 200K lines/inch (e.g. within a range of 50K lines/inch or more and 200K lines/inch or less), the length of the brush 72*b* may be of 10 mm to 20 mm (e.g. within a range of 10 mm or more and 20 mm or less), and the length of the bristle implanted to the shaft portion 72*a* may be of 2 mm to 5 mm (e.g. within a range of 2 mm or more and 5 mm or less). The electric resistivity of the brush 72*b* when a voltage of 500 V is applied to the application roller 72 may be of $10\times10^{12}$ [Ω·cm] or less.

The application roller 72 may rotate in a direction in which the application roller 72 follows the image carrier 40, that is, in a counterclockwise direction, as shown in FIG. 3. A linear velocity switching unit may be connected to the application roller 72, and the linear velocity of the application roller 72 may be controlled by the linear velocity switching unit. For example, the linear velocity of the application roller 72 at the contact position with the image carrier 40 may be set to be faster than the linear velocity of the image carrier 40, by the linear velocity switching unit.

For example, a flicker 74 for scraping off the toner adhering to the brush 72*b* may contact the brush 72*b* of the application roller 72. The flicker 74 may be formed in a plate shape and may be located at a position in which the flicker 74 bites into the rotationally moving brush 72*b*. A lubricant 75 forming a solid lubricated molded body may be supported on an opposite side of the application roller 72 from the image carrier 40.

As an example, the lubricant 75 may be applied to the image carrier 40 to prolong the life expectancy of the image carrier 40. The application roller 72 applies the lubricant 75 to the image carrier 40. For example, the application roller 72 scrapes off the lubricant 75 from the solid lubricant 75 and applies the scraped lubricant 75 to the image carrier 40. The lubricant 75 may include a metal soap. As an example, the lubricant 75 may include a material containing zinc stearate.

The electric resistivity of the lubricant 75 may be of $1.0\times10^{9}$ [Ω·cm] to $1.0\times10^{15}$ [Ω·cm] (e.g. within a range of $1.0\times10^{9}$ [Ω·cm] or more and $1.0\times10^{15}$ [Ω·cm] or less). The image forming apparatus 1 may further includes a lubricant support member 76 for supporting the lubricant 75, a lubricant pressurizing member 77 for pressurizing the lubricant 75 to bring the brush 72*b* of the application roller 72 into contact with the image carrier 40. The lubricant pressurizing member 77 may include a compression coil spring as an example.

The toner supplied to the image carrier 40 may move (or transfer) from the image carrier 40 to the application roller 72, and adhere to the application roller 72. An amount of toner of the application roller 72 that is equal to or more than a predetermined amount may improve suppression of abrasion of the image carrier 40, since the application performance of the lubricant 75 on the image carrier 40 is maintained. On the other hand, an amount of the toner on the application roller 72 that is less than a predetermined amount may lead to a progressive abrasion of the image carrier 40, due to a possibility that the application performance of the lubricant 75 on the image carrier 40 is not being maintained.

The example image forming apparatus 1 monitors the amount of toner carried by the application roller 72 and controls the amount of toner carried by the application roller 72. As an example, the image forming apparatus 1 includes a toner measuring unit 80 that measures the amount of toner moving (or transferred) from the image carrier 40 to the application roller 72, and a control unit 90 that adjusts the supply of the toner supplied to the image carrier 40 in accordance with the amount of toner measured by the toner measuring unit 80.

For example, the toner measuring unit 80 may measure the amount of toner by measuring the electrostatic capacity of the application roller 72. The toner measuring unit 80 may apply an AC voltage between the shaft portion 72*a* of the application roller 72 and an electrode close to the brush 72*b*, and measure the magnitude of the AC current flowing when applying the AC voltage, thereby measuring the electrostatic capacity of the brush 72*b*. For example, when the electrostatic capacity of the application roller 72 is equal to or higher than a predetermined electrostatic capacity threshold value, the toner measuring unit 80 may determine that the amount of toner is suitable, and when the electrostatic capacity of the application roller 72 is not equal to or higher than the predetermined electrostatic capacity threshold value (e.g. when the electrostatic capacity is less than the predetermined electrostatic capacity threshold value), the toner measuring unit 80 may determine that the amount of toner is not suitable.

Figure 4:
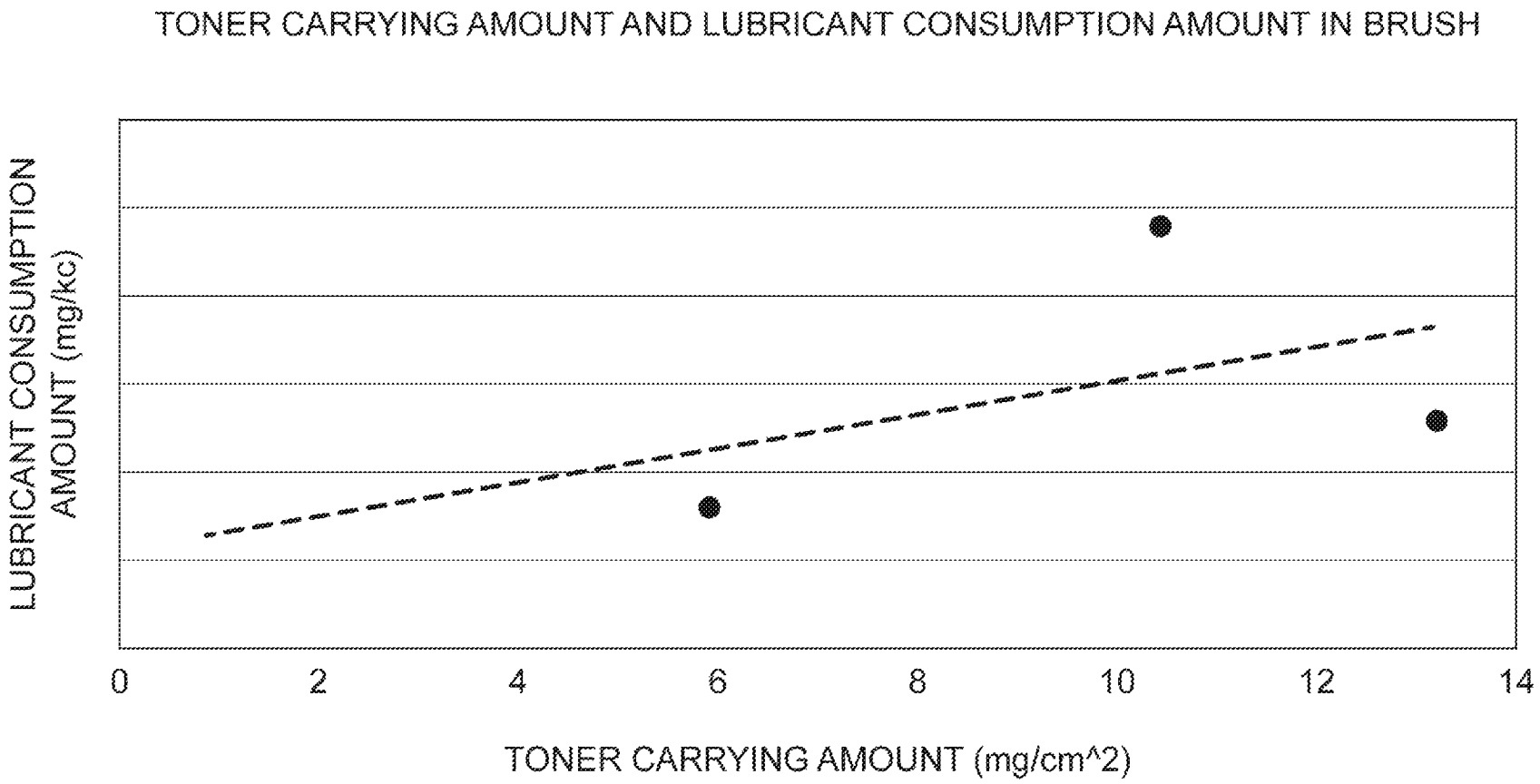
FIG. 4 is a graph showing a relationship of a consumption amount of a lubricant and a carrying amount of toner of an example application roller.

As an example, when the amount of toner of the application roller 72 is equal to or greater than the toner amount threshold value, the toner measuring unit 80 determines that the amount of toner is suitable, and when the amount of toner of the application roller 72 is not equal to or greater than the toner amount threshold value, the toner measuring unit 80 determines that the amount of toner is not suitable. As an example, the toner amount threshold value may be about 2 mg/cm$^2$. FIG. 4 is a graph showing experiment results representing a relationship between the carrying amount of toner of the example application roller 72 and the consumption amount of the lubricant 75. The carrying amount of toner of the application roller 72 is measured by a suction method.

The suction method is a method of measuring the amount of toner by sucking the toner adhering to a region per unit area of the application roller 72 to the filter and by measuring the weight of the toner adhering to the filter by suction. The consumption amount of the lubricant 75 indicates, for example, the amount of the lubricant 75 that has moved (or was transferred) to the image carrier 40 by the application roller 72. According to the graph illustrated in FIG. 4, there is a positive correlation between the carrying amount of toner of the application roller 72 and the consumption amount of the lubricant 75, and if the amount of toner carried is 2 $mg/cm^2$ or more, it is possible to improve the movement (or transfer) of the lubricant 75 to the image carrier 40.

As an example, the toner measuring unit 80 may measure the amount of toner by measuring the electrical resistance of the application roller 72. Since the toner is made of an insulating material, it is possible to determine that the amount of toner carried by the brush 72*b* is large when the value of the electrical resistance of the brush 72*b* is high. For example, the toner measuring unit 80 may apply a DC voltage between the shaft portion 72*a* of the application roller 72 and an electrode close to the brush 72*b*, and measure the magnitude of the DC current flowing when applying the DC voltage, thereby measuring the electrical resistance of the brush 72*b*. When the value of the electrical resistance of the application roller 72 is equal to or higher than the predetermined electrical resistance threshold value, the toner measuring unit 80 may determine that the amount of toner is suitable, and when the value of the electrical resistance of the application roller 72 is not equal to or higher than the electrical resistance threshold (e.g. when the value of the electrical resistance is less than the electrical resistance threshold), the toner measuring unit 80 may determine that the amount of toner is not suitable.

Figure 5:
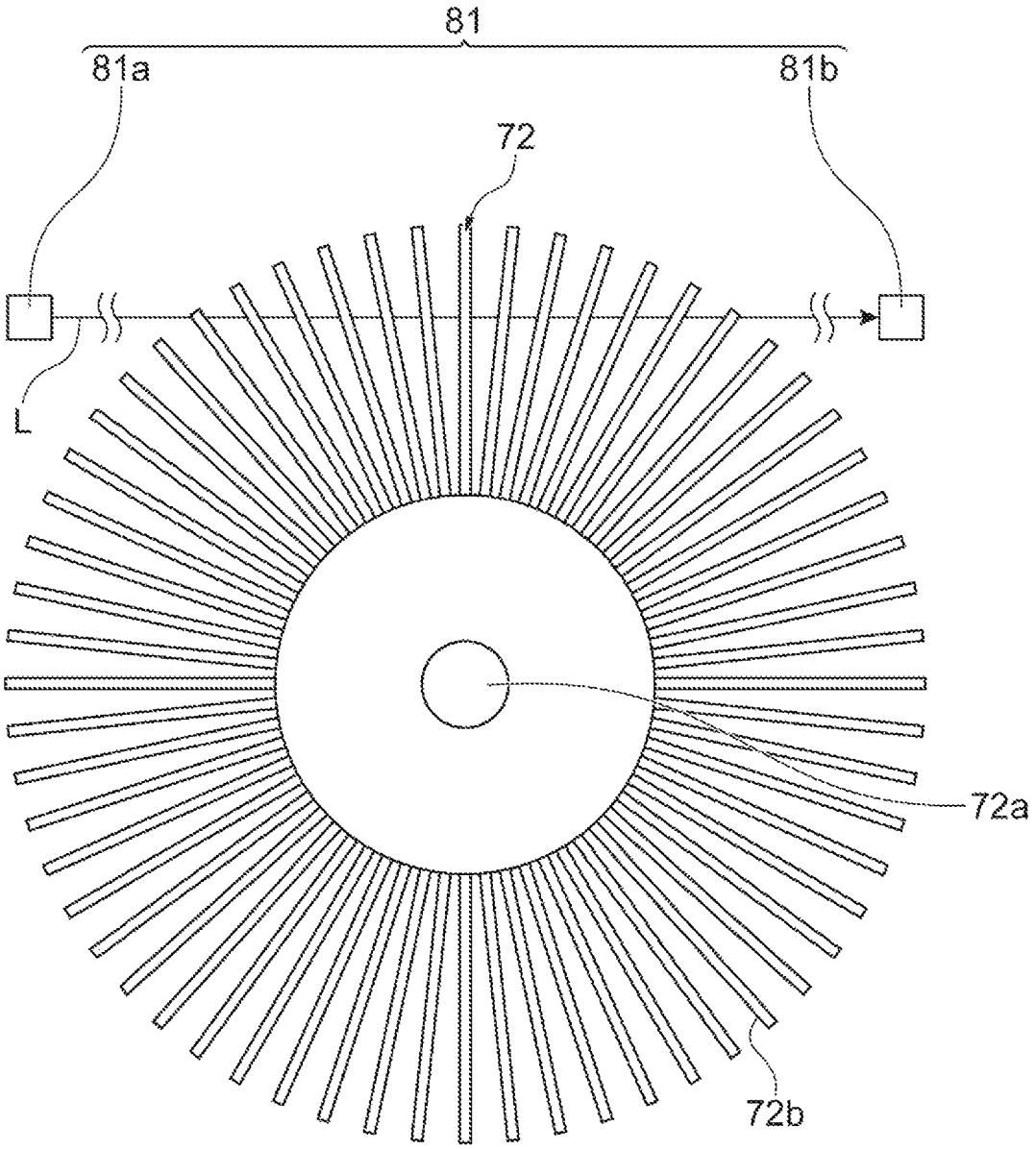
FIG. 5 is a schematic diagram illustrating an example optical sensor and an example application roller.

With reference to FIG. 5, the toner measuring unit 80 may include an optical sensor 81 which measures the amount of toner adhering to the application roller 72. As an example, the optical sensor 81 may include an irradiation unit 81*a* which irradiates the application roller 72 with light L, and a detection unit 81*b* which detects light L radiated from the irradiation unit 81*a* and passes through the application roller 72. For example, when the light amount of the light L detected by the detection unit 81*b* is equal to or less than the predetermined light amount threshold value, the toner measuring unit 80 determines that the amount of toner of the application roller 72 is suitable, and when the light amount of the light L measured by the detection unit 81*b* is larger than the light amount threshold value, the toner measuring unit 80 determines that the amount of toner of the application roller 72 is not suitable. Further, the optical sensor 81 may include a detection unit that detects the light L radiated from the irradiation unit 81*a* and reflected from the application roller 72.

The toner measuring unit 80 may measure the amount of toner of the application roller 72 by measuring the torque transmitted to the application roller 72. For example, as the amount of toner adhering to the application roller 72 increases, the torque of the application roller 72 may increase, and as the amount of toner adhering to the application roller 72 decreases, the torque of the application roller 72 may decrease. Thus, it is possible to measure the amount of toner from the torque of the application roller 72. When the torque of the application roller 72 is equal to or higher than the predetermined torque threshold value, the toner measuring unit 80 may determine that the amount of toner of the application roller 72 is suitable, and when the torque of the application roller 72 is not equal to or higher than the torque threshold value (e.g. when the torque of the application roller 72 is less than the torque threshold value), the toner measuring unit 80 may determine that the amount of toner of the application roller 72 is not suitable.

The control unit 90 may control the amount of toner supplied from the toner tank N to the image carrier 40 via the developing device 20. The control unit 90 may increase the amount of toner to be supplied to the image carrier 40 when the measured amount of toner of the application roller 72 is equal to or smaller than the toner amount threshold value. For example, when it is determined by the toner measuring unit 80 that the amount of toner of the application roller 72 is not suitable, the control unit 90 may adjust the supply of the toner to be supplied to the image carrier 40 in accordance with the amount of toner measured by the toner measuring unit 80.

The control unit 90 may supply toner to the application roller 72 by formation of an electrostatic latent image on the image carrier 40. As an example, the control unit 90 may form an electrostatic latent image on the image carrier 40 by irradiating the outer circumferential surface of the image carrier 40 with the laser beam, using the exposure unit 42. When the toner is supplied from the developing roller 21 to the electrostatic latent image of the image carrier 40, the toner may be supplied from the image carrier 40 to the application roller 72.

The control unit 90 may change the voltage applied to the application roller 72 and supply the toner to the application roller 72. In this case, the movement (or transfer) of the toner from the image carrier 40 to the application roller 72 is promoted by application of the voltage to the application roller 72. As an example, when the toner is negatively charged, the control unit 90 may apply a positive voltage to the application roller 72 and attract the toner to the application roller 72.

The control unit 90 may change the rotation speed of the application roller 72 and supply the toner to the application roller 72. The control unit 90 may supply toner from the image carrier 40 to the application roller 72 with a difference between the rotation speed of the application roller 72 and the rotation speed of the image carrier 40. As an example, the control unit 90 may reduce the rotation speed of the application roller 72 with respect to the image carrier 40 to supply toner from the image carrier 40 to the application roller 72. As another example, the control unit 90 may supply the toner from the image carrier 40 to the application roller 72 by rotating the application roller 72 in a direction opposite to the driven direction of the image carrier 40.

The control unit 90 may stop the transfer of the image developed on the image carrier 40 to the transfer device 30, thereby supplying the toner to the application roller 72. In this case, since the toner of the image carrier 40 remains on the outer circumferential surface of the image carrier 40 without being transferred, the amount of toner moving (or transferred) from the image carrier 40 to the application roller 72 increases, and a greater amount of toner is supplied to the application roller 72.

Figure 6:
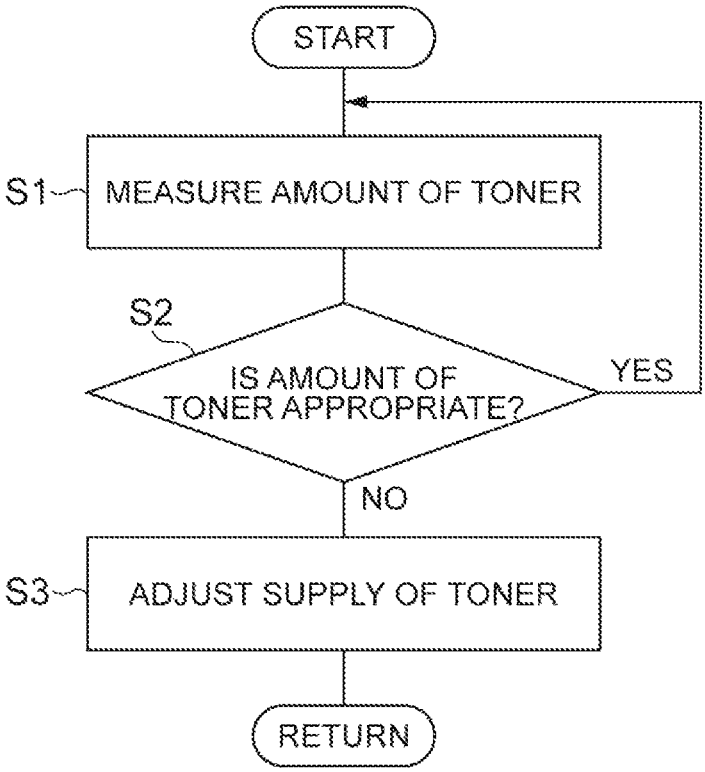
FIG. 6 is a flowchart illustrating an example process of controlling an amount of toner adhering to an example application roller.

An example method of measuring an amount of toner of the application roller 72 and controlling supply of toner to the application roller 72 will be described with reference to the flowchart of FIG. 6. Processes other than those illustrated in FIG. 6 may be added to the process illustrated in the flow chart illustrated in FIG. 6, and one or more part of the process illustrated in FIG. 6 may be changed or deleted.

At S1 the toner measuring unit 80 measures the amount of toner of the application roller 72. For example, the toner measuring unit 80 may measure the amount of toner of the application roller 72, by at least one of the measurement of the electrostatic capacity of the application roller 72, the measurement of the electrical resistance of the application roller 72, the optical sensor 81, and the measurement of the torque transmitted to the application roller 72.

At S2, the toner measuring unit 80 may determine whether or not the amount of toner of the application roller 72 is suitable. If the toner measuring unit 80 determines that the amount of toner is suitable, the process proceeds to S1, and the amount of toner is continued to be measured. If the toner measuring unit 80 determines that the amount of toner is not suitable, the process proceeds to S3, and the control unit 90 adjusts the supply of toner to the application roller 72. For example, the control unit 90 may adjust the supply of the toner to the application roller 72, by performing at least one of formation of an electrostatic latent image to the image carrier 40, change of the voltage of the application roller 72, change of the rotation speed of the application roller 72, and stoppage of the transfer to the transfer device 30.

According to the above-described example image forming apparatus 1, since the toner measuring unit 80 measures the amount of toner of the application roller 72, and the control unit 90 controls the supply of toner to the application roller 72, the application roller 72 may apply a suitable amount of the lubricant 75 to the image carrier 40. Therefore, since the application performance of the lubricant 75 on the image carrier 40 is improved, and the lubricant 75 is suitably applied to the image carrier 40, the life expectancy of the image carrier 40 can be prolonged.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. An image forming apparatus comprising:

an image carrier;

a toner supply unit to supply toner to the image carrier;

an application roller located at a position adjacent to the image carrier and to apply a lubricant to the image carrier;

a toner measuring unit to measure an amount of toner transferred from the image carrier to the application roller; and a control unit to adjust the supply of toner to be supplied to the image carrier in accordance with the amount of toner measured by the toner measuring unit.

2. The image forming apparatus according to claim 1, wherein the image carrier is a photoreceptor, the application roller is a brush roller, and the control unit to increase an amount of toner to be supplied to the photoreceptor when a measured amount of toner of the brush roller is equal to or less than a toner amount threshold value.

3. The image forming apparatus according to claim 1, the toner measuring unit to measure the amount of toner by measuring electrostatic capacity of the application roller.

4. The image forming apparatus according to claim 1, the toner measuring unit to measure the amount of toner by measuring electrical resistance of the application roller.

5. The image forming apparatus according to claim 1, wherein the toner measuring unit includes an optical sensor to measure an amount of toner adhered to the application roller, and the optical sensor includes an irradiation unit to irradiate the application roller with light, and a detection unit to detect light radiated from the irradiation unit and passing through the application roller.

6. The image forming apparatus according to claim 1, wherein the toner measuring unit includes an optical sensor to measure an amount of toner adhered to the application roller, and the optical sensor includes an irradiation unit to irradiate the application roller with light, and a detection unit to detect light radiated from the irradiation unit and reflected from the application roller.

7. The image forming apparatus according to claim 1, the toner measuring unit to measure the amount of toner by measuring a torque transmitted to the application roller.

8. The image forming apparatus according to claim 1, the control unit to supply toner to the application roller by formation of an electrostatic latent image on the image carrier.

9. The image forming apparatus according to claim 1, the control unit to change a voltage applied to the application roller, to supply the toner to the application roller.

10. The image forming apparatus according to claim 1, the control unit to change a rotation speed of the application roller, to supply the toner to the application roller.

11. The image forming apparatus according to claim 10, the control unit to reduce the rotation speed of the application roller, to supply the toner to the application roller.

12. The image forming apparatus according to claim 10, the control unit to rotate the application roller in a direction opposite to the rotation direction of the image carrier, to supply the toner to the application roller.

13. The image forming apparatus according to claim 1, further comprising:

a transfer member on which an image developed on the image carrier is transferred, the control unit to supply toner to the application roller by stopping transfer of the image developed on the image carrier to the transfer member.

14. A method comprising;

measuring an amount of toner transferred from an image carrier to a lubricant application roller in an imaging device;

comparing the amount of toner measured to a threshold toner amount; and increasing a supply of toner to the image carrier when the measured amount of toner transferred to the lubricant application roller is below the threshold toner amount.

15. The method according to claim 14, wherein the lubricant application roller comprises a brush roller having bristles, and wherein the amount of toner transferred from the image carrier to the lubricant application roller is measured based on at least one parameter selected from the group consisting of: an electrostatic capacity of the bristles, an electrical resistance of the bristles, an amount of light radiated through the bristles, an amount of light reflected from the bristles, a torque transmitted to the lubricant application roller.

* * * * *